US007748151B2

(12) United States Patent
Glass

(10) Patent No.: US 7,748,151 B2
(45) **Date of Patent: *Jul. 6, 2010**

(54) STABILIZED A-FRAME SIGN STAND

(75) Inventor: Geoffrey M. Glass, Wheeling, IL (US)

(73) Assignee: American Louver Company, Skokie, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/950,243

(22) Filed: Dec. 4, 2007

(65) Prior Publication Data

US 2008/0216370 A1 Sep. 11, 2008

Related U.S. Application Data

(63) Continuation-in-part of application No. 11/164,897, filed on Dec. 9, 2005, now Pat. No. 7,302,770.

(51) Int. Cl.
*G09F 15/00* (2006.01)

(52) U.S. Cl. ..... 40/610; 40/606.01; 116/63 P; 248/465

(58) Field of Classification Search ..... 40/610, 40/584, 606.01; 116/63 P; D20/40, 10
See application file for complete search history.

(56) References Cited

U.S. PATENT DOCUMENTS 3,056,377 A * 10/1962 Nelson ..... 248/472
4,081,119 A * 3/1978 Messmore ..... 206/454
4,253,260 A * 3/1981 Maza et al. ..... 40/610
5,009,541 A * 4/1991 Thurston ..... 404/6
5,046,885 A * 9/1991 Thurston ..... 404/10
5,927,676 A * 7/1999 Lefton ..... 248/472
6,131,320 A * 10/2000 Eberle et al. ..... 40/610
6,393,748 B1 * 5/2002 Cooper ..... 40/610

OTHER PUBLICATIONS

"Quick Sign Frame," http://web.archive.org/web/20060118022609/http://www.victorystore.com/quicksign/index.htm, Jan. 18, 2006.*

"PolySign—Portable Plastic Sidewalk Signs," http://web.archive.org/web/20060616060623/http://www.mysignprinter.com/id94.html, Jun. 16, 2006.*

Two photos taken of sign frame manufactured by Excel Signs, production of which is believed to have begun on or around Jan. 2006.

* cited by examiner

*Primary Examiner*—Gary C Hoge
(74) *Attorney, Agent, or Firm*—Brinks Hofer Gilson & Lione

(57) ABSTRACT

An improved A-frame sign stand is disclosed. The sign stand includes front and rear panels hingedly attached. A support rod is removably attachable to the panels and prevents both separation and buckling of the panels. The support rod can be placed into various storage positions. In one such position, the rod may be used as a handle. In another embodiment, the rod can be pivoted upward and stored on an inner surface of the panel.

11 Claims, 7 Drawing Sheets

STABILIZED A-FRAME SIGN STAND

CROSS-REFERENCE TO RELATED APPLICATIONS

This is a continuation-in-part of application Ser. No. 11/164,897, filed Dec. 9, 2005 now U.S. Pat. No. 7,302,770, which is hereby incorporated by reference in its entirety.

BACKGROUND OF THE INVENTION

1. Field of the Invention

The present invention relates to A-frame signs of the type frequently used by realtors, and more specifically, to an improved A-frame sign stand having a support rod with various configurations.

2. Description of the Related Art

Various sign stands are used in numerous applications. For example, sign stands are frequently used in the real estate industry. Signs are typically placed in a yard for temporary usage.

Conventional sign stands can be of the type that are anchored into the ground. However, in various applications, A-frame sign stands of the type which have two panels which are hingedly attached to one another.

Such A-frame signs tend to have various problems. For example, such sign stands can tend to open further than desired, or buckle inwards. Various solutions have been proposed to prevent undesired opening of such stands. For example, U.S. Pat. No. 5,358,762 issued to McGrath, discloses an A-frame sign having a strap which is attached to the front and rear panels. This strap does not have a convenient storage location. Also, such a strap does not prevent buckling of the sign stand.

Similarly, U.S. Pat. No. 4,253,260, issued to Maza et al., discloses a sign stand having straps at the bottom. The straps may serve to prevent further separation of the panels, however, they will not prevent inward buckling of the panels. Furthermore, the straps may hang out and be in the way in the event that the sign is folded for storage, or in the event that multiple signs are stored or transported.

Various other sign stands have been proposed, however, each of such solutions are deficient in various manners.

Therefore, there remains a need for an improved A-frame type sign stand which resolves the various deficiencies of the prior art.

SUMMARY

In view of the deficiencies described above, it is an object of the present invention to provide an improved sign stand. It is a further object of the present invention to provide an improved A-frame sign stand having a convenient support rod having various features and advantages.

The present invention is an A-frame sign stand. The stand includes a support rod which extends from the bottom center of the front panel to the bottom center portion of the rear panel. The support rod is preferably rigid.

The support rod preferably attaches to a molded receiving portion in the center of the bottom portion of each of the panels. In various embodiments, the support rod is removably attached to the panels, and can be placed in an open position to hold the panels in place. This will serve both to prevent the panels from separating beyond a desired point, as well as preventing them from buckling inward.

In various embodiments, the support rod is removably attachable to the panels in a storage, or closed, position. For example, the support rod may be stored in a horizontal position and snapped into molded receiving regions on one of the front or rear panels. Thus, the support rod can be stored in an easily accessible manner, and chances of loss during storage are decreased. Furthermore, in the storage position, the support rod may be accessible from the outside of the stand when the stand is collapsed, and usable for various purposes such as mounting, tying multiple such sign stands together, or as a handle.

In certain embodiments, the front and rear panels may have an opening therethrough, such as to enable positioning of a sign. The support rod may be attached along lower edges of such an opening.

A second spare support rod may be provided and stored in one of the two panels so that it can be available in the event that one is lost.

In various other embodiments, the support rod may be permanently affixed to one center portion of one of the panels, and removably attachable to the other panel. The support rod can then be pivoted upward and snapped into place into preferably molded receiving portions on the inner surface of the panel for storage.

Other features and advantages of the invention will be apparent from the following detailed description taken in conjunction with the following figures, wherein like reference numerals represent like features.

DETAILED DESCRIPTION OF THE INVENTION

Figure 1:
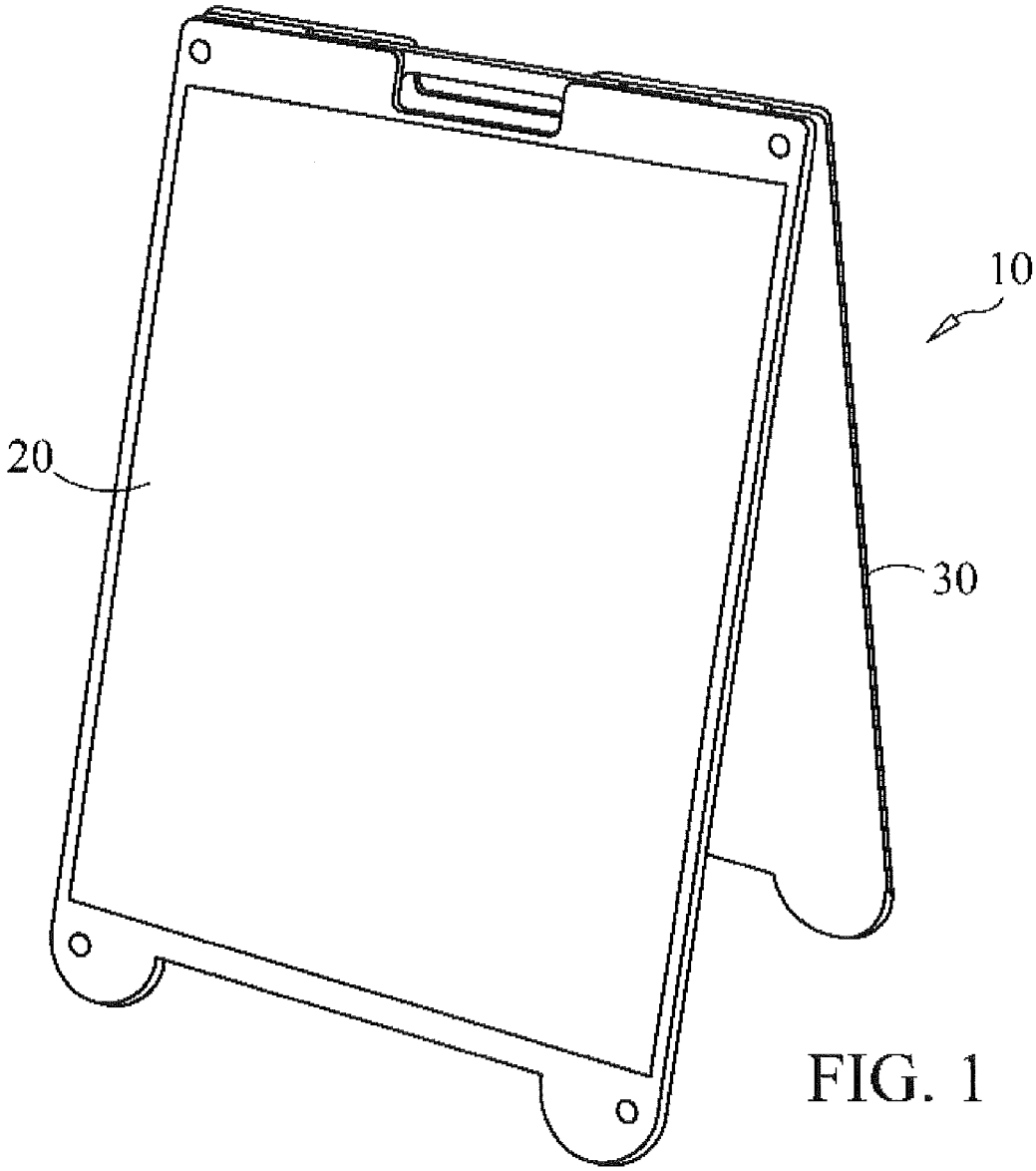
FIG. 1 is a perspective view of the sign stand of the present invention in an open position.
Figure 2:
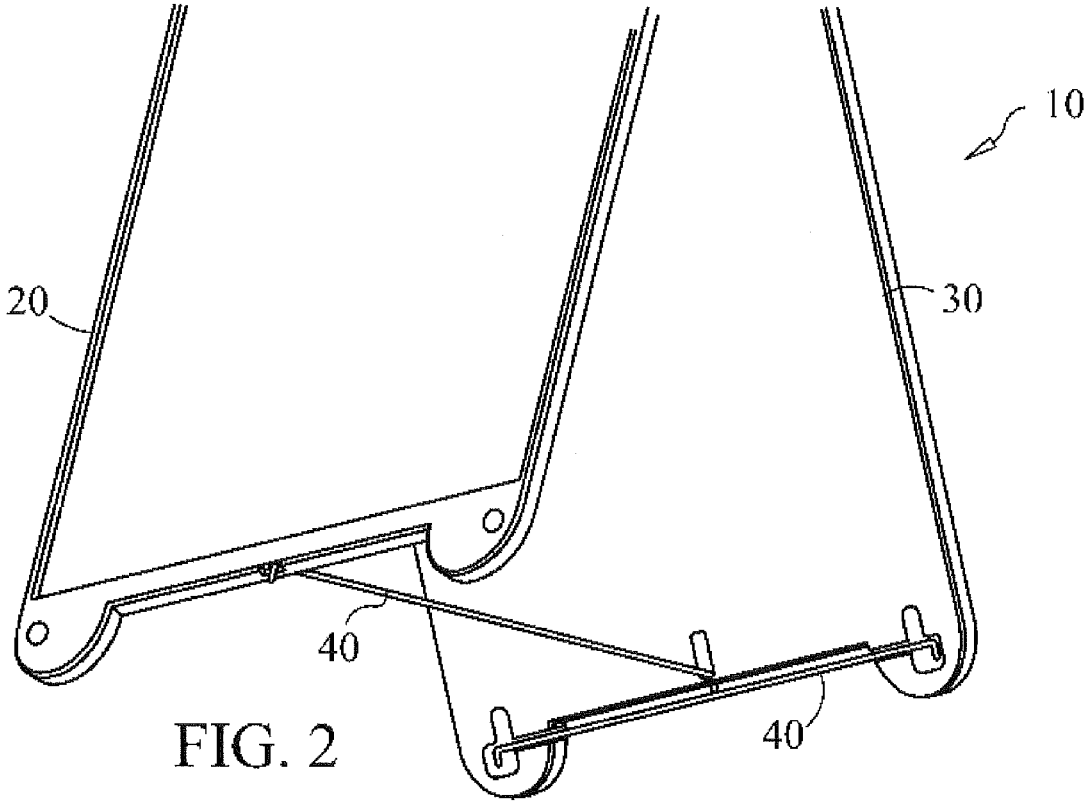
FIG. 2 is a perspective view of the bottom portion of the sign stand of the present invention.
Figure 3:
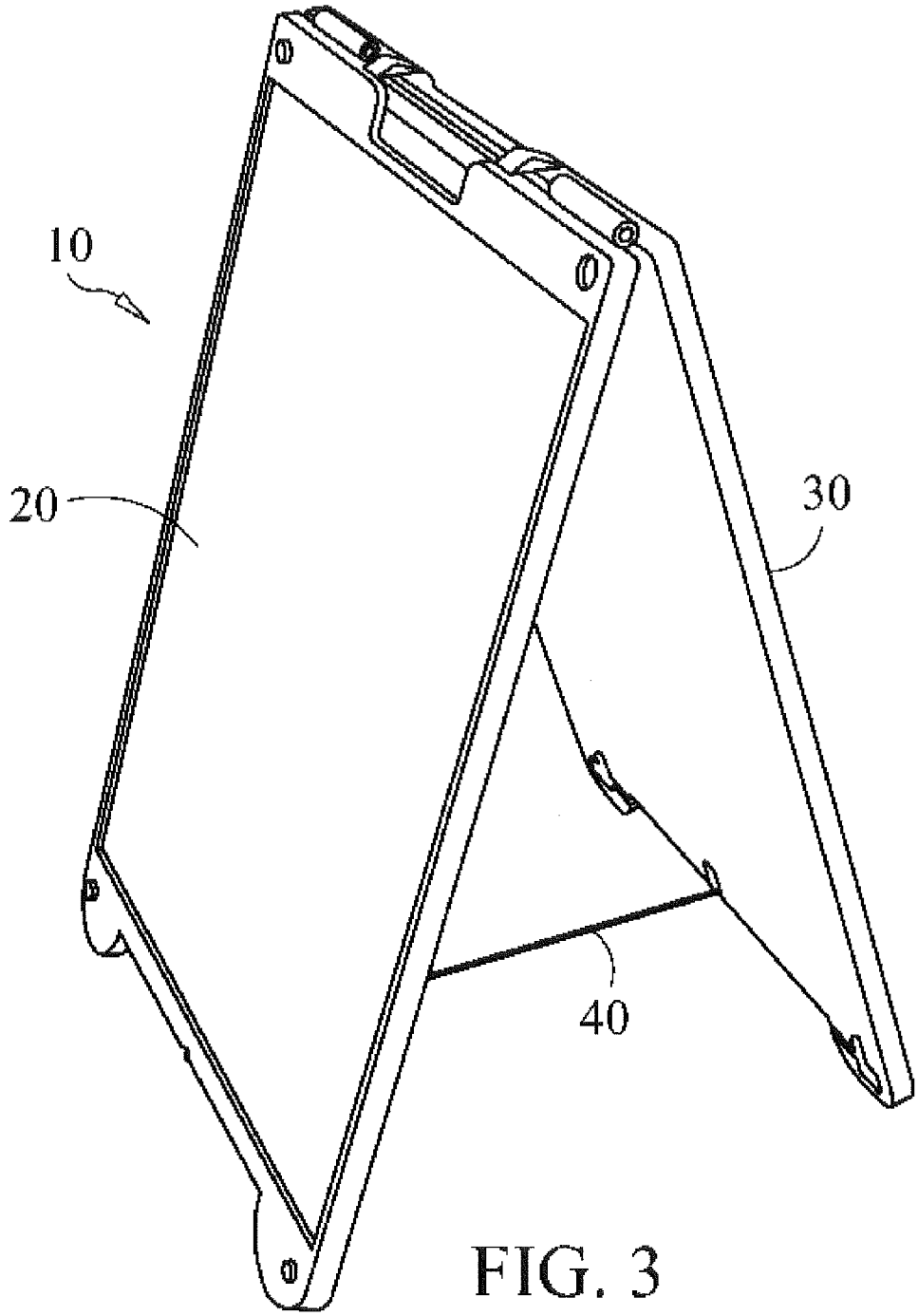
FIG. 3 is a perspective side view of the sign stand of the present invention showing the support rod in an open position.

While this invention is susceptible of embodiments in many different forms, there are shown in the drawings and will herein be described in detail, preferred embodiments of the invention with the understanding that the present disclosure is to be considered as an exemplification of the principles of the invention and is not intended to limit the broad aspect of the invention to the embodiments illustrated.

In various embodiments, the present invention is an improved A-frame sign stand 10. The stand includes a front panel 20 and a rear panel 30. The panels 20 and 30 are hingedly connected at their top portions. The panels 20 and 30 may be formed of any suitable material. In various preferred embodiments, the panels 20 and 30 are formed of molded plastic. In a preferred embodiment, the panels 20 and 30 are blow-molded.

Figure 4:
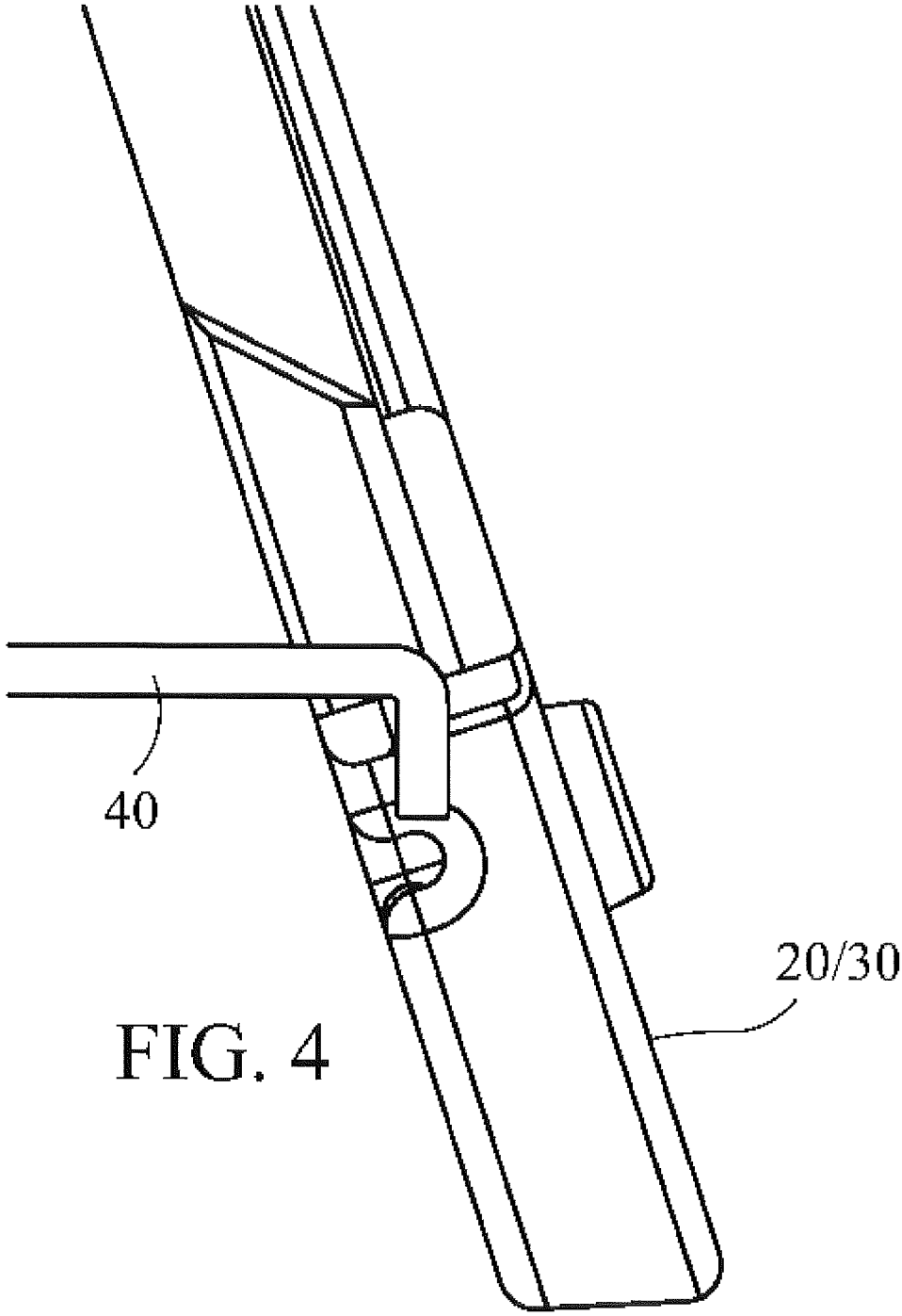
FIG. 4 is a cut-away side view of the connection between the support rod and the panel in the sign stand of the present invention.

A removably attachable rigid support rod 40 is removably attachable to a bottom portion of the front panel 20 and a bottom portion of the rear panel 30. The rod 40 may be formed of any suitable material. Preferably, the rod 40 is a rigid metal material. Preferably, the rod 40 includes a bent portion at each end, and the bent portion is compatible with a molded receiving portion on each of the front panel 20 and rear panel 30, as shown in FIG. 4. The receiving portions are preferably centrally located along the bottom edge of the panels 20 and 30.

Figure 5:
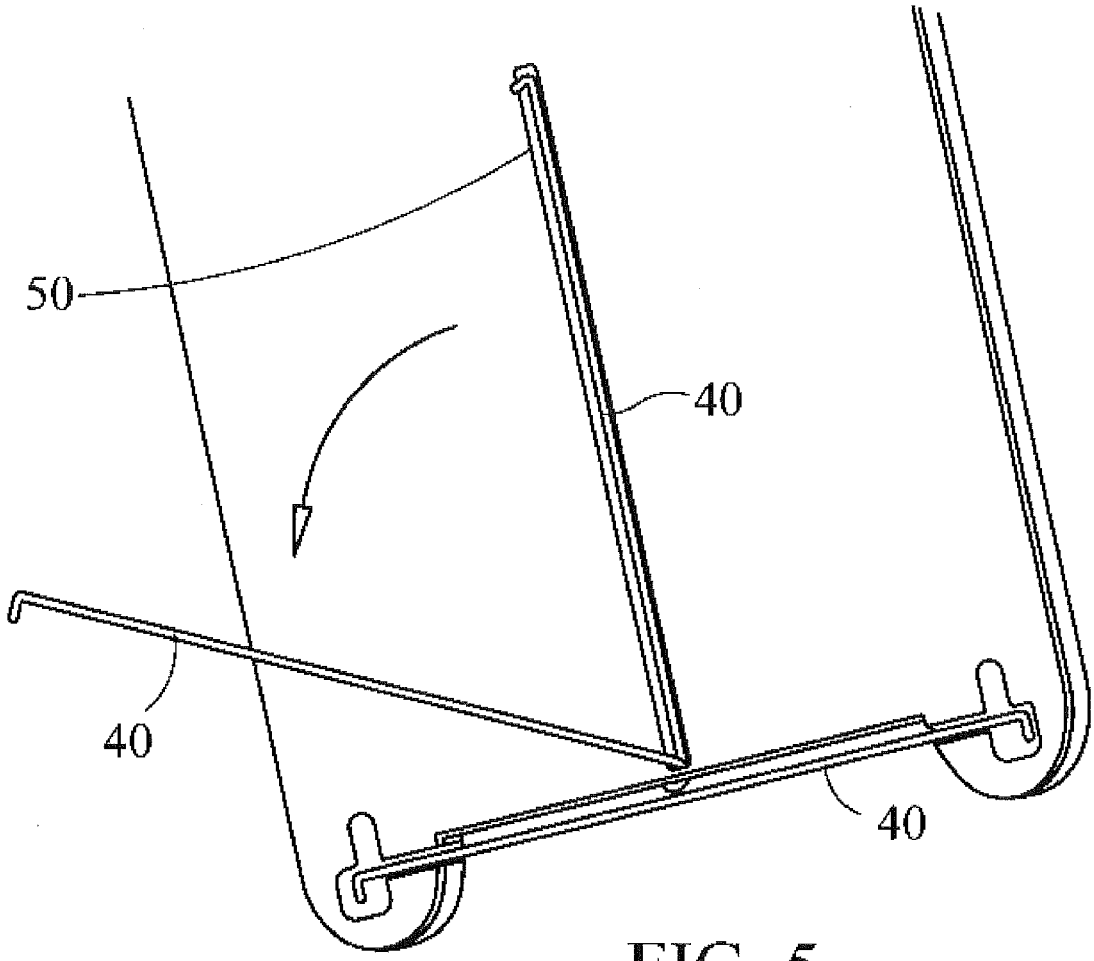
FIG. 5 is a perspective view of the inner side of one of the panels showing another embodiment of the support rod and receiving portions of the sign stand of the present invention.

Preferably, the support rod 40 is positionable in two modes. In a first open mode, the rod 40 is removably attached to bottom portions of each of the front and rear panels 20 and 30 as described. In the closed mode, the support rod is removably but firmly attached to receiving regions on one of the two panels 20 and 30, as can be seen in FIG. 5. Ideally, the receiving regions are molded into inner surfaces of one of the panels 20 and 30. In various embodiments, this closed mode attachment is configured in a horizontal position and the rod 40 is accessible from the outside when the sign 10 is collapsed.

Figure 6:
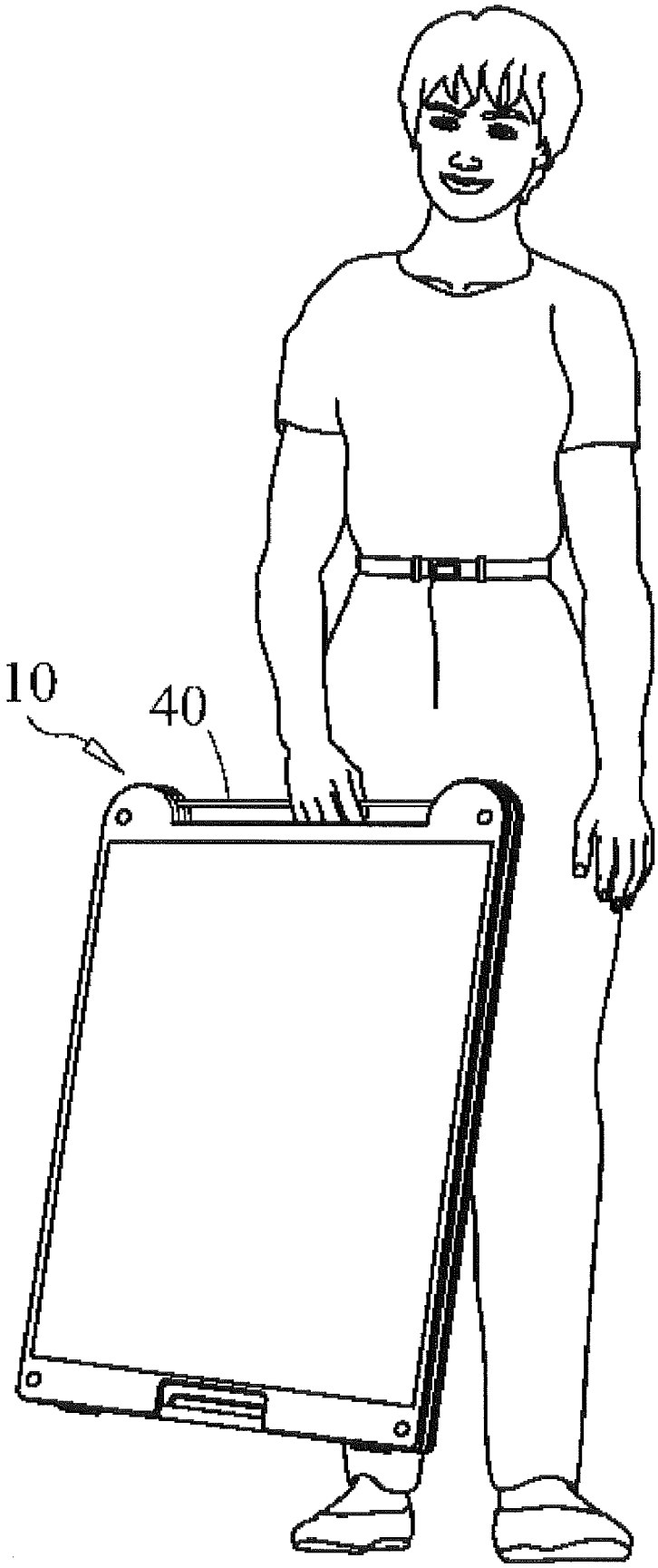
FIG. 6 is a perspective view showing one embodiment of the sign stand of the present invention in a closed position.
Figure 7:
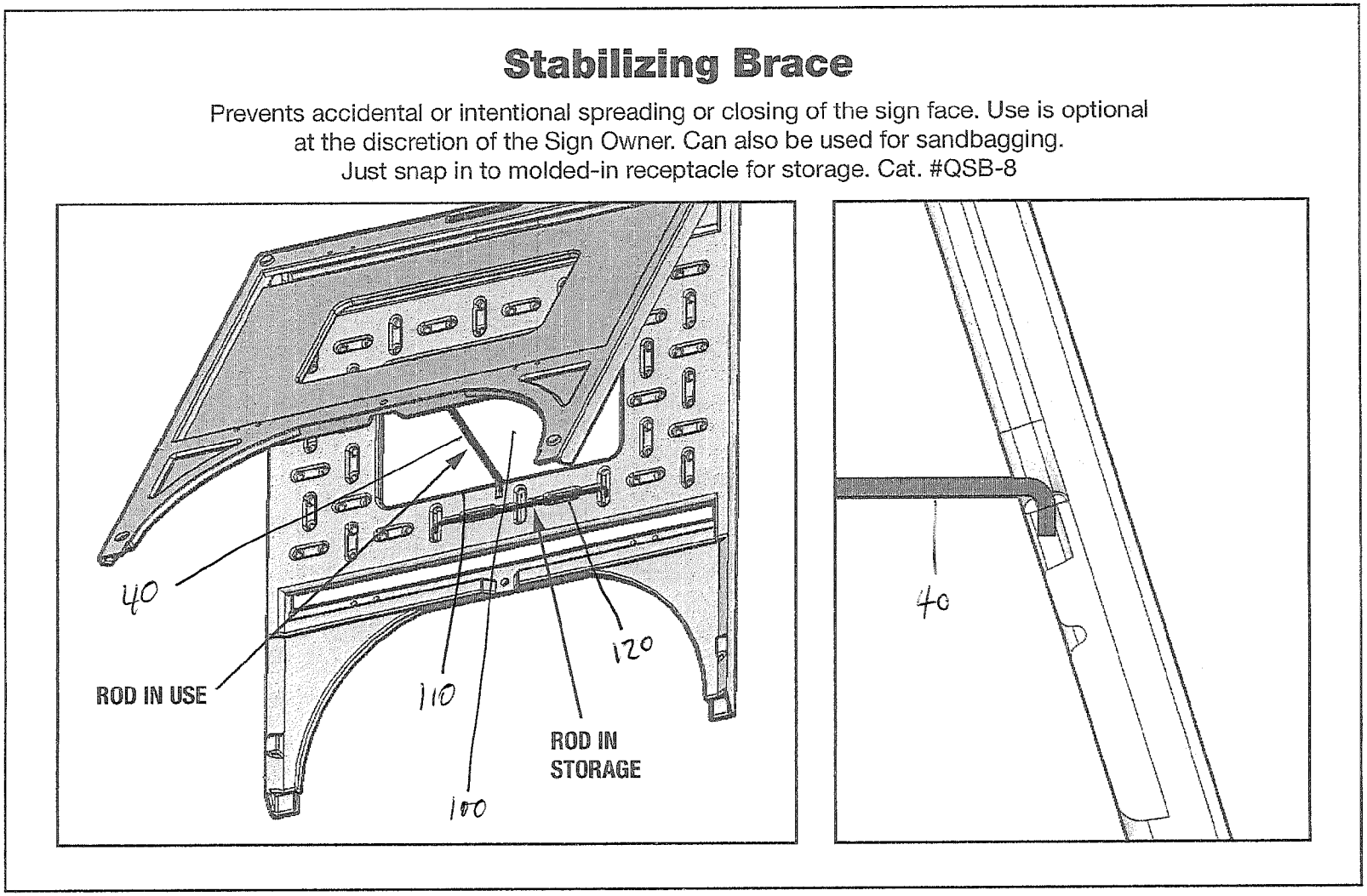
FIG. 7 is a perspective view showing one embodiment of the sign stand of the present invention in an open position.

In such a configuration, the rod 40 can be used as a handle as shown in FIG. 6, or it can be used for mounting or for tying multiple such sign stands together for storage or transportation.

In various embodiments, an extra support rod 40 is provided such that it is available in the event that one of the support rods 40 should become lost.

In other embodiments of the present invention, the support rod 40 may be permanently pivotally attached to one of the panels 20 and 30 at a center bottom portion. In such embodiments, the support rod 40 may be pivoted upward and stored in a vertical position. Preferably, a vertical receiving region 50 is molded into one of the panels 20 and 30 on its inner surface to receive rod 40.

In further embodiments of the present invention, panels 20 and 30 may include openings 100 therein. Each opening 100 includes a lower edge 110. The support rod 40 is attached substantially along the lower edges 110. Either of panels 20 and 30 may include molded receiving areas 120 to receive rod 40 in the closed mode.

While specific embodiments have been illustrated and described, numerous modifications come to mind without significantly departing from the spirit of the invention and the scope of protection is limited by the scope of the accompanying claims.

What is claimed is:

1. A stabilized A-frame sign stand comprising:

a front panel, a rear panel hingedly connected at a top portion to said front panel, a removably attachable rigid support rod wherein said removably attachable rigid support rod is removably attachable to a middle portion of said front panel and a middle portion of said rear panel, the middle portion of said front panel and the middle portion of said rear panel being substantially centered in-between sides of the front panel and rear panel, respectively, via molded through-hole receiving portions in said middle portion of said front panel and said middle portion of said rear panel wherein said sign is movable without said support rod being displaced, wherein said support rod is removably attachable to said sign stand in two selectable modes comprising an open mode and a closed mode, where in the open mode said support rod is attached to middle portions of each of the front and rear panels, and wherein in the closed mode said support rod is attached to one of said rear panel and said front panel wherein said support rod remains secured to the one of said rear panel and said front panel independently of whether said sign stand is in an open or close position, and wherein in said closed mode said support rod is attached to one of said rear panel and said front portion via molded receiving members on an inner surface of said panel.

2. The stabilized A-frame sign stand according to claim 1, wherein said support rod comprises a bent portion at each end, and wherein the bent portion is compatible with a molded receiving portion on each of said front panel and said rear panel.

3. The stabilized A-frame sign stand according to claim 1, wherein in the closed mode the support rod is oriented in a vertical position with respect to said panels.

4. The stabilized A-frame sign stand according to claim 1, wherein in the closed mode said support rod is oriented in a horizontal position relative to said panels.

5. The stabilized A-frame sign stand according to claim 4, wherein in the closed mode said support rod is accessible and configured to be usable to tie multiple such sign stands together.

6. The stabilized A-frame sign stand according to claim 4, wherein in the closed mode said support rod is accessible and configured to be usable as a handle.

7. The stabilized A-frame sign stand according to claim 1, further comprising a second extra support rod, said second support rod being attached to the other of said rear panel and said front panel via molded receiving members on an inner surface of said panel in the closed mode.

8. The stabilized A-frame sign stand according to claim 3, wherein on end of said support rod is permanently pivotably attached to the bottom portion of the one of said panels.

9. The stabilized A-frame sign stand according to claim 1, wherein in the open mode said support rod prevents the sign from both opening further and closing further.

10. A stabilized A-frame sign stand comprising:

a front panel having a opening therethrough, the opening having a lower edge, a rear panel hingedly connected at a top portion to said front panel, a removably attachable rigid support rod wherein said removably attachable rigid support rod is removably attachable at a first end at a first point substantially along the lower edge of the opening in said front panel, attachable at a second end at a second point on said rear panel, wherein in a closed mode said support rod is attached to one of said rear panel and said front panel via molded receiving members on an inner surface of said panel, and wherein in the closed mode said support rod is oriented in a horizontal position relative to said panels.

11. The stabilized A-frame sign stand according to claim 10, wherein said rear panel has an opening therethrough, said opening having a lower edge, and wherein the second point is substantially along the lower edge of said opening in said rear panel.

* * * * *